US006788798B1

(12) United States Patent
Backman

(10) Patent No.: US 6,788,798 B1
(45) Date of Patent: Sep. 7, 2004

(54) METHOD AND ARRANGEMENT FOR IMPROVING LEAK TOLERANCE OF AN EARPIECE

(75) Inventor: Juha Backman, Espoo (FI)

(73) Assignee: Nokia Mobile Phones Ltd, Espoo (FI)

( * ) Notice: Subject to any disclaimer, the term of this patent is extended or adjusted under 35 U.S.C. 154(b) by 0 days.

(21) Appl. No.: 09/166,404

(22) Filed: Oct. 5, 1998

(30) Foreign Application Priority Data

Oct. 6, 1997 (FI) ..... 973892

(51) Int. Cl.[7] ..... H04R 25/00
(52) U.S. Cl. ..... 381/372; 381/371
(58) Field of Search ..... 381/312, 371, 381/372

(56) References Cited

U.S. PATENT DOCUMENTS 4,239,945 A * 12/1980 Atoji et al. ..... 179/182
5,029,217 A * 7/1991 Chabries et al. ..... 381/68.2
5,313,661 A 5/1994 Malmi et al. ..... 455/232.1
5,608,803 A * 3/1997 Magotra et al. ..... 381/68.2

* cited by examiner

*Primary Examiner*—Forester W. Isen
*Assistant Examiner*—Elizabeth McChesney
(74) *Attorney, Agent, or Firm*—Perman & Green LLP

(57) ABSTRACT

The invention relates to an arrangement for improving leak tolerance in an earpiece. The invention can be applied preferably in teleterminals, particularly in mobile stations. One idea of the invention is that an acoustic return path (314, 313, 311, 312, 320) is directed from the back part of the earpiece capsule (301) to a volume (307) between the earpiece (300) and the user's ear. By means of the solution according to the invention an optimum, controlled load is achieved particularly for low frequencies, such that a change in the volume (307) between the earpiece and the ear only has a minor effect on the volume and quality of the sensed sound. By means of the solution a good leak tolerance is achieved, even though the volume to be arranged behind the earpiece capsule is small.

25 Claims, 3 Drawing Sheets

METHOD AND ARRANGEMENT FOR IMPROVING LEAK TOLERANCE OF AN EARPIECE

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention relates to a method and an arrangement for improving leak tolerance in an earpiece. The invention can be applied preferably in teleterminals, particularly in mobile stations.

2. Description of the Related Art

Teleterminals conventionally contain a receiver part which has an earpiece for reproducing the received acoustic signal. The earpiece has been conventionally designed in such a way that it forms the maximum sound volume and the best quality of sound when the earpiece is sealed against the user's ear. If there is a gap, i.e. a leak between the earpiece and the user's ear, this usually causes a significant weakening of the sensed sound pressure. Additionally, the frequency distribution of the sensed sound does not then correspond to the original acoustic signal but low frequencies are attenuated to a greater extent than high frequencies. The ability of an earpiece to maintain its acoustic properties when the gap between the earpiece and the ear changes, is called its leak tolerance.

The problem described above is extremely serious particularly in mobile stations, because the mobile station is rarely completely sealed against the user's ear. On the other hand, standards relating to mobile stations are primarily based on measurements where the gap between the mobile station and the artificial ear has been arranged so that there is a tight seal. In order to ensure that the volume and frequency distribution of the reproduced sound are according to the specifications also in real operating conditions, extremely good leak tolerance is required from the earpiece arrangement.

To improve leak tolerance the following ways are prior known. The leak tolerance can be improved by arranging a loose coupling to the membrane which produces the sound waves in the earpiece capsule and by loading it by a relatively large volume situated behind the earpiece capsule. Most preferably the volume behind the earpiece capsule has been arranged to be open, in which case the aforementioned volume becomes as large as possible. Another way to improve the leak tolerance is to lower the acoustic output impedance of the arrangement by using an acoustic return path.

FIG. 1 shows an earpiece 100 according to prior art. It comprises an earpiece capsule 101 which converts an electric signal into an acoustic sound. The earpiece capsule 101 is connected to the housing 103 of the earpiece by its edges 102. The sound wave formed by the earpiece capsule is generated in the volume 104 between the earpiece 101, the edges 102 and the housing 103, from which it is transferred to the external volume of the housing through holes 105. Between the housing 103 and the ear 106 there remains a volume 107 which thus in an optimal situation is closed. If the earpiece is a part of a mobile station, the housing 103 is preferably the cover of the mobile station.

In the solution shown in FIG. 1, leak tolerance has been improved by arranging an acoustic return path from the back part of the earpiece capsule to the front part of it. The acoustic return path is formed of the holes 114 in the back part of the earpiece capsule, the volume 113 behind the earpiece capsule, the volume 112 on the sides of the earpiece capsule and the holes 115 in the front edge of the earpiece capsule. The volume arranged for said acoustic return path has been closed by a special casing 110 in the solution of FIG. 1, but the volume can also be formed by a normal casing of a device, such as a mobile station, and the components inside it. In the solution shown in FIG. 1 an acoustic volume 113 has been arranged for the acoustic path and it can contain material attenuating high frequency components. The ability to improve leak tolerance in the solution shown in FIG. 1 is based on the fact that the return path arranged especially for low frequencies operates as an acoustic load for the earpiece capsule at low frequencies, in which case the changes in external load have a smaller relative effect on the acoustic total load of the earpiece capsule.

A disadvantage of the above described solution according to prior art is that the load caused by the acoustic return path is difficult to optimize. The leak tolerance to be achieved depends essentially on the size of the volume arranged behind the earpiece capsule. In small-sized devices, such as mobile stations, it is often impossible to provide a sufficiently large volume to achieve the optimum acoustic load.

FIG. 2 shows an acoustic equivalent circuit of an earpiece according to FIG. 1. In it, the earpiece capsule forms a pressure wave by operating as an acoustic source 201 and comprising an internal impedance 204. The pressure wave propagates to the outside of the earpiece arrangement through holes in the casing, such that the holes form an impedance 205 and the external volume forms a load impedance 206. The interface between the earpiece and the external volume has been marked by 207 in FIG. 1. The acoustic return path operates as a feedback impedance 215. The load impedance 206 consists mainly of the load caused by the ear and the load resulting from the leak between the earpiece and the ear. It can be noted from the equivalent circuit that the changes in the load impedance 206 have a major impact on the acoustic power which is transferred to the load, and by means of the feedback impedance, the effect of load variation can be reduced to only a minor extent.

OBJECT OF THE INVENTION

The aim of the present invention is to devise an earpiece solution which achieves good leak tolerance in a small-sized device, such as a mobile station.

BRIEF SUMMARY OF THE INVENTION

One idea of the invention is that the acoustic return path is directed from the back part of the earpiece capsule to the volume between the earpiece and the user's ear. By means of the solution according to the invention, an optimum, controlled load especially for low frequencies is achieved, in which case a change in the volume between the earpiece and the ear only has a minor effect on the volume and the frequency distribution of the sensed sound. By means of the solution a good leak tolerance is achieved, though the volume to be arranged behind the earpiece capsule is small.

A method according to the invention for improving leak tolerance in an earpiece such that the sound formed by an earpiece capsule is directed through the first acoustic path to the first volume which is confined by the user's ear and the housing part between the earpiece capsule and the ear, is characterized in that from the back part of the earpiece capsule a sound formed by the earpiece capsule is directed to said first volume through the second acoustic path.

An arrangement according to the invention for improving leak tolerance of an earpiece, which comprises an earpiece capsule, a housing part situated between the earpiece capsule and the user's ear for confining the first acoustic volume between said housing part and user's ear and the first acoustic path arranged between the front part of the earpiece capsule and the first acoustic volume for directing sound from the front part of the earpiece capsule to the first acoustic volume, is characterized in that the arrangement comprises additionally the second acoustic path arranged from the back part of the earpiece capsule to said first volume.

A mobile station according to the invention, whose earpiece comprises an earpiece capsule, a housing part situated between the earpiece capsule and the user's ear for confining the first acoustic volume between said housing part and user's ear and the first acoustic path arranged between the front part of the earpiece capsule and the first acoustic volume for directing sound from the front part of the earpiece capsule to the first acoustic volume, is characterized in that the earpiece comprises additionally the second acoustic path arranged from the back part of the earpiece capsule to said first volume for improving leak tolerance.

Preferable embodiments of the invention have been presented in dependent claims.

By the front and back parts of the earpiece capsule one means herein the front and back parts of a membrane which forms sound waves and is situated in the earpiece capsule, and sound waves generated in these front and back parts are in opposite phases from each other.

By the earpiece one means herein the earpiece capsule and acoustic and mechanical structures connected to it.

BRIEF DESCRIPTION OF THE SEVERAL VIEWS OF THE DRAWINGS

In the following the invention is described in more detail by means of the attached drawings in which.

DETAILED DESCRIPTION OF THE INVENTION

Figure 1:
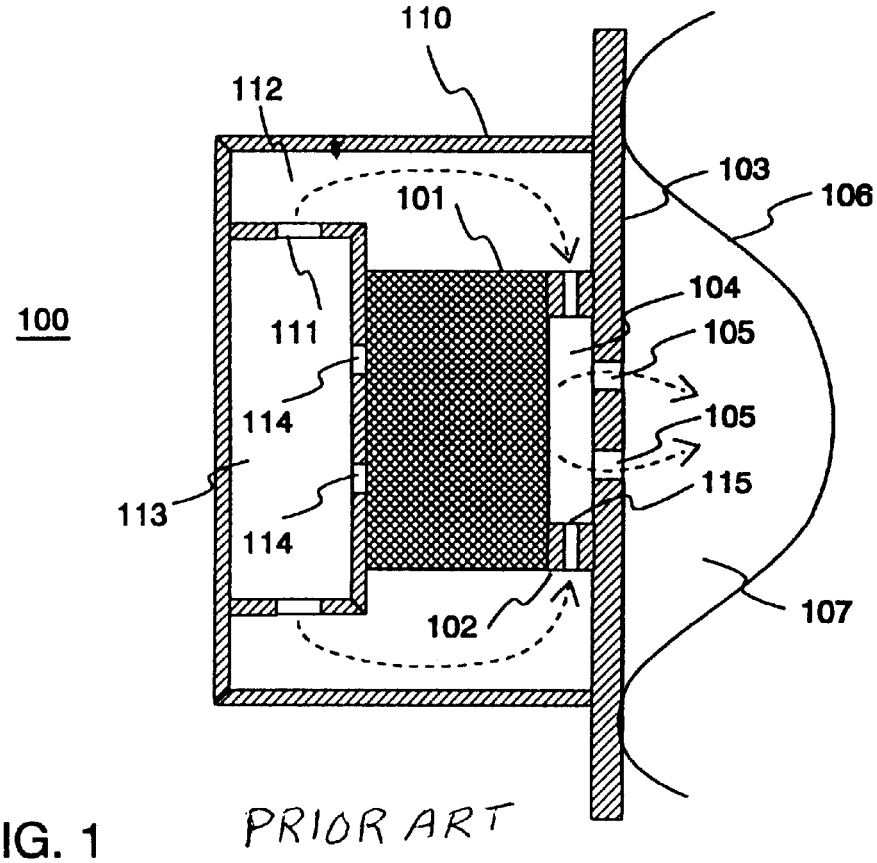
FIG. 1 shows an earpiece arrangement according to prior art.
Figure 2:
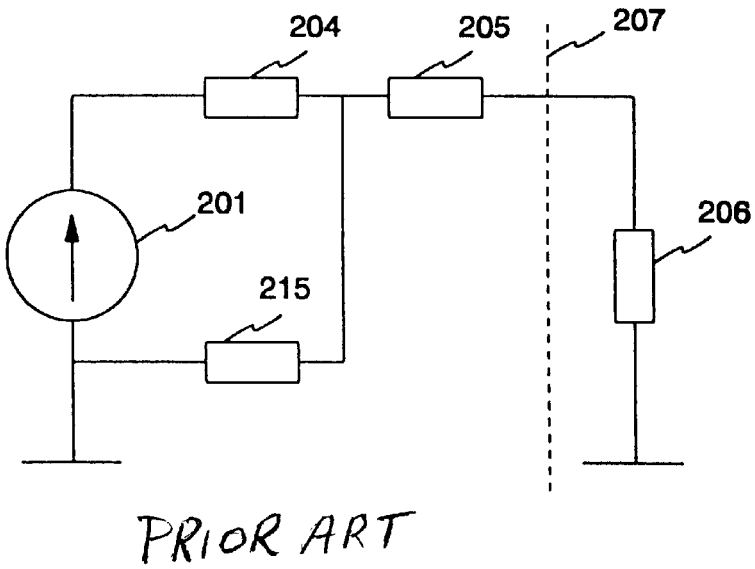
FIG. 2 shows an acoustic equivalent circuit of the earpiece arrangement according to FIG. 1.

FIGS. 1 and 2 were already described above in the context of the description of prior art.

Figure 3:
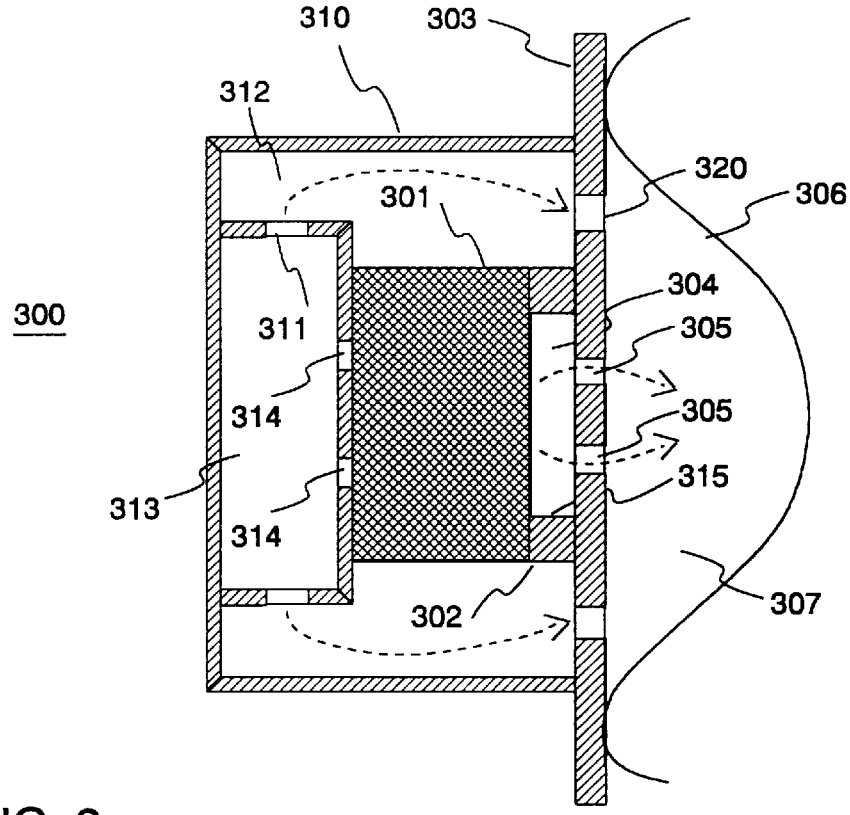
FIG. 3 shows an arrangement according to the invention for improving leak tolerance of an earpiece.

FIG. 3 shows an arrangement according to the invention for improving leak tolerance of an earpiece. It comprises an earpiece capsule 301 which converts an electric signal into an acoustic sound. The earpiece capsule 301 is connected to the housing part 303 of the earpiece by its edges 302. The sound wave formed by the earpiece capsule is generated in the volume 304 between the earpiece capsule 301, the edges 302 and the housing part 303, from which it is transferred to the external volume of the housing through holes 305 which form the first acoustic path. Between the housing part 303 and the ear 306 the first volume 307 is confined. If the earpiece is a part of a mobile station, the housing part is preferably the cover of the mobile station.

In the solution shown in FIG. 3 the leak tolerance has been improved according to the invention by arranging the second acoustic path from the back part of the earpiece capsule 301 to the first volume 307. The second acoustic path is formed of the holes 314 in the back part of the earpiece capsule, the volume 313 behind the earpiece capsule, the volume 312 on the side of the earpiece capsule and holes 320 arranged in the housing part.

The volume arranged on the sides of the earpiece capsule has been closed by a special casing 310 in the solution of FIG. 3. Additionally, in the solution shown in FIG. 3, behind the earpiece capsule an optimum acoustic volume 313 has been arranged which can contain material for attenuating high frequency components. Volumes 313 and 312 need, however, not necessarily be volumes separated from each other but they can form one combined volume.

The ability to improve leak tolerance in the solution shown in FIG. 3 is based, according to the invention, on the fact that the acoustic return path arranged particularly for low frequencies operates as an acoustic load for the earpiece capsule at low frequencies, in which case the changes in external load have a smaller relative effect on the acoustic total load of the earpiece capsule. When the second acoustic path has been, according to the invention, directed to the first volume between the ear and the housing part, it is possible to use the small volume behind the earpiece capsule for arranging the second acoustic path and still gain the optimum load at low frequencies. Thus, for example, applied to a mobile station, the arrangement according to the invention does not cause any significant enlargement in the size of the mobile station or have any effect on its shape.

The holes 320 of the housing part 303 which have been arranged for forming the second acoustic path are preferably in the same size range as the holes 305 arranged for the first acoustic path. These additional holes 320 of the housing part are the only detail which is visible to the user resulting from the arrangement according to the invention. Thus the arrangement according to the invention has no significant impact on the appearance of the device.

Figure 4:
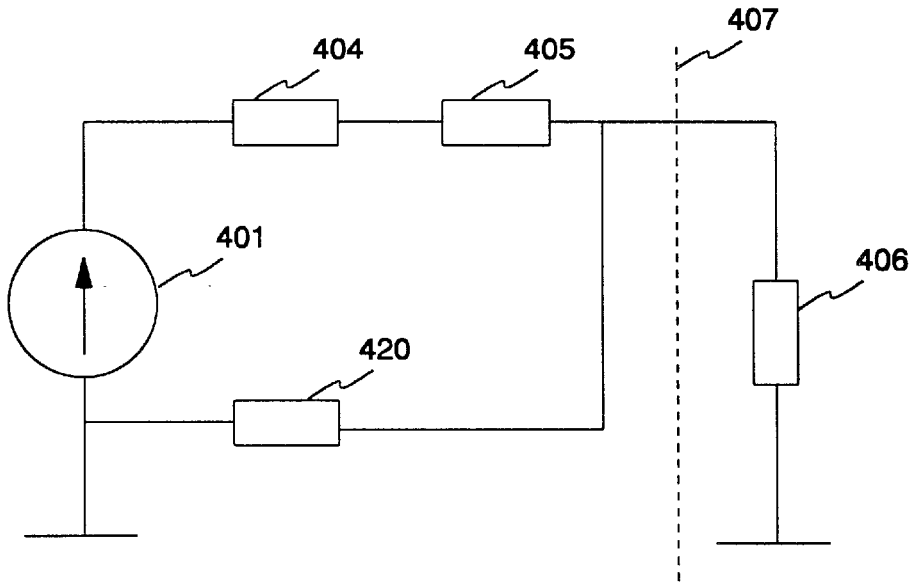
FIG. 4 shows an acoustic equivalent circuit of the earpiece arrangement according to FIG. 3.

FIG. 4 shows a simplified acoustic equivalent circuit of an earpiece according to FIG. 3. In it, the earpiece capsule forms a pressure wave and functions thus as an acoustic source 401 to which an internal impedance 404 is further connected. The pressure wave propagates to the outside of the earpiece arrangement through the holes in the casing, in which case the holes form an acoustic impedance 405 and the external volume a load impedance 406. The interface between the earpiece and the external volume has been marked by 407 in FIG. 4. The acoustic return path operates herein as a feedback impedance 420. From the equivalent circuit one can notice now that the effects of the changes in the load impedance 406 on the acoustic power which is transferred to the load can be minimized by means of a feedback impedance 420, because the feedback impedance compensates for the effect of the holes 305 in the casing, that is the effect of the acoustic impedance 405. If the situation according to the invention is compared with the solution according to prior art shown in FIG. 2, one can further notice that to achieve a certain pressure level (corresponding to the voltage of an electric circuit) to the listener's ear 406 at a certain impedance value seen from the acoustic source, less acoustic volume velocity (corresponding to current in an electrical circuit) is needed in the solution according to the invention. This means that in order to achieve a given level of audibility, a smaller movement of the membrane in the earpiece capsule is needed.

Next, the application of the present invention to a mobile station is studied. At first, by means of FIG. 5, the operation of a conventional mobile station is described and thereafter, the mechanical structure of a mobile station according to the invention is described by means of FIG. 6.

Figure 5:
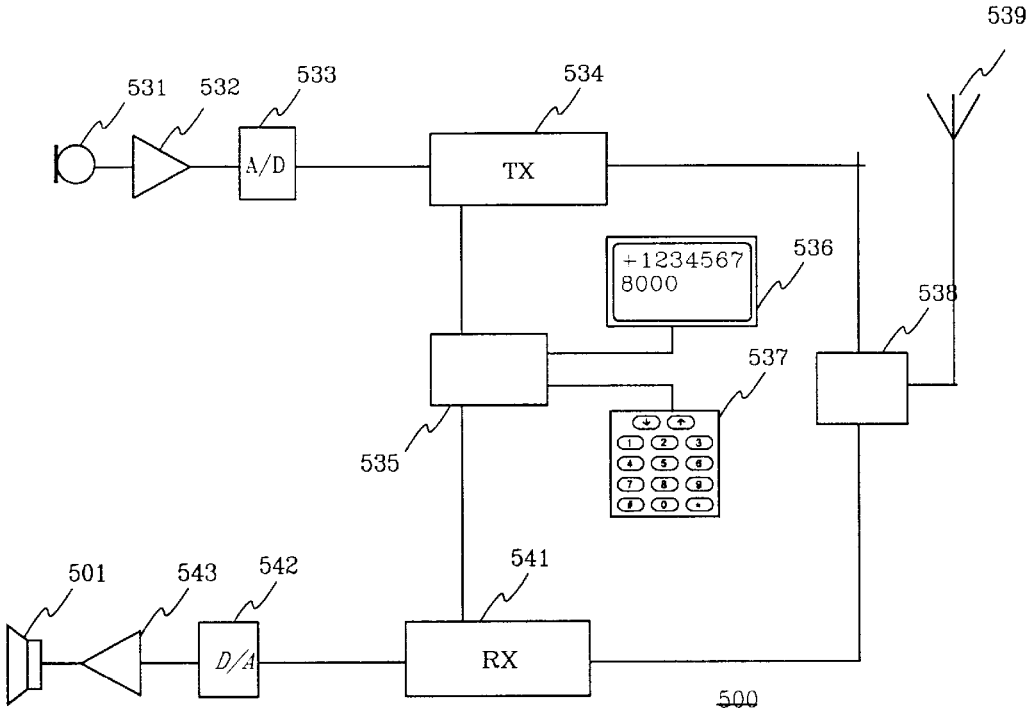
FIG. 5 shows a block diagram of a prior known mobile station to which the present invention can preferably be applied and FIG. 6 shows a mobile station according to the invention from the front and the side.

FIG. 5 shows a block diagram of a mobile station according to an embodiment as an example of the invention. The mobile station comprises the parts which are typical of the device, such as a microphone 531, a keyboard 537, a display 536, an earpiece 501, a transmission/reception coupling 538, an antenna 539 and a control unit 535. Additionally, the figure shows transmission and reception blocks 534, 541 which are typical of the mobile station.

The transmission block 534 comprises operations needed for speech coding, channel coding, ciphering and modulation, and RF operations. The reception block 541 comprises corresponding RF operations and operations needed for demodulation, deciphering, channel decoding and speech decoding. A signal which comes from the microphone 531, which has been amplified at an amplification stage 532 and converted into a digital form in an A/D converter is transferred to the transmission block 534, typically to a speech coding element included in the transmission block. The transmission signal which has been shaped, modulated and amplified by the transmission block is directed via the transmission/reception coupling 538 to the antenna 539. The signal to be received is brought from the antenna via the transmission/reception coupling 538 to the reception block 541 which demodulates the received signal and performs the deciphering and the channel decoding. The speech signal received as a final result is transferred via a D/A converter 542 to an amplifier 543 and further to an earpiece 501. The control unit 535 controls the operation of the mobile station, reads control commands given by the user from the keyboard 537 and delivers messages to the user via the display 536.

When an earpiece arrangement according to the invention is used, the frequency response of the earpiece may differ from the frequency response of the arrangement according to prior art. The frequency response can be compensated analogically by using a filter which is included in the amplifier 543. Another alternative is to perform the compensation in the context of digital signal processing in the digital signal processor (DSP) of block 541. When the frequency response is corrected on the digital signal processor, component changes are not necessarily needed, but the correction can be performed by making the necessary additions to the program which controls the digital signal processor.

Figure 6:
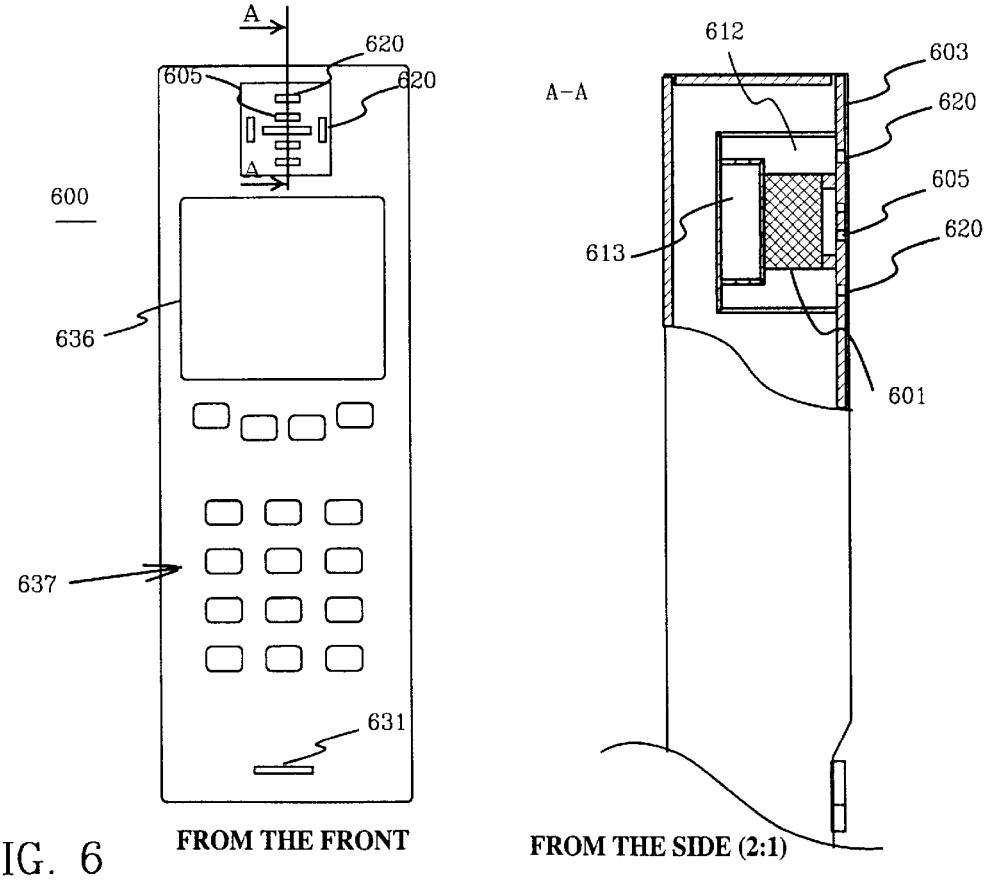

FIG. 6 shows a mechanical structure of a mobile station 600 according to the invention viewed from the front and the side. The side view has been enlarged by 2:1 compared to the front view and it shows a partial cross section A—A at the position of an earpiece according to the invention. The front view shows a microphone 631, a keyboard 637 and a display 636 which are included in a conventional mobile station. On the top part of the mobile station one can see holes 605 which form the first acoustic path leading from the front part of the earpiece capsule to the outside of the device and holes 620 which are a part of the second acoustic path. In the cross-sectional view one can see additionally volumes 612 and 613 which are a part of the second acoustic path. The volumes 612 and 613 need not necessarily be separated but they can also form one combined volume. The housing of the earpiece between the earpiece and the user's ear is in the mobile station preferably the cover 603 of the device to which other mechanical parts of the earpiece are connected.

Above, an embodiment of the solution according to the invention has been described. The principle according to the invention can naturally be modified within the frame of the scope defined by the claims, for example, by modification of the details of the implementation and ranges of use.

What is claimed is:

1. A method for improving leak tolerance in a small earpiece for a mobile station, comprising the steps of:

providing an earpiece capsule for disposing at the ear of a user and for forming a sound received therein, wherein the sound formed by the earpiece capsule is directed via a first acoustic path to a first acoustic volume which is confined by the ear of the user, disposing a housing part of the mobile station between the earpiece capsule and the user's ear for conducting the formed sound to the user's ear wherein the housing part is substantially flat and the first acoustic volume is formed in a cavity created when the user's ear substantially directly contacts the housing part, and directing the sound formed by the earpiece capsule from the back part of the earpiece capsule to said first acoustic volume by means of a second acoustic path wherein the second acoustic path is arranged to compensate for the effect of changes in the first acoustic volume on the intensity and/or frequency characteristics of the sound sensed by the user's ear, the second acoustic path comprising an acoustic return path for low frequencies that operate as an acoustic load for the earpiece capsule at low frequencies, the second acoustic path having the highest acoustic effect on low frequencies.

2. The method of claim 1 wherein sound formed by the earpiece capsule is directed from the back part of the earpiece capsule through at least one aperture in the back part of the earpiece capsule into the second acoustic path.

3. The method of claim 1 wherein the acoustic return path is adapted to cause changes in an external load on the earpiece capsule to have a small relative effect on an acoustic total load of the earpiece capsule.

4. The method of claim 1 wherein the sound formed by the earpiece capsule from the back part of the earpiece is directed from the back part of the earpiece capsule into a second volume and then into a third volume, the second and third volume being separated by a casing, and the third and first volume being separated by the housing part.

5. The method of claim 1 wherein the second acoustic path directs the sound formed by the earpiece capsule from the back part of the earpiece capsule into a second acoustic volume in the back part of the earpiece and then into a third acoustic volume arranged on either side of the earpiece, the second acoustic volume and each third acoustic volume being separated by a casing part.

6. The method of claim 1 wherein the second acoustic path comprises a first volume behind the earpiece capsule that is smaller in area than the earpiece capsule and a second volume around sides of the earpiece capsule, and wherein apertures in a casing surrounding the first and second volume direct sound from the earpiece into the first volume and into the second volume, and sound from the second volume is directed to the first acoustic volume by apertures in the housing part.

7. The method of claim 6 further comprising confining the first volume behind the earpiece capsule from the second volume around the sides of the earpiece capsule, and allowing sound from the earpiece to travel from the first volume to the second volume via apertures in a casing between the first volume and second volume.

8. The method of claim 6 further comprising lining a casing of the first volume behind the earpiece with a material adapted to alternate high frequency components of the signal.

9. The method of claim 6 further comprising minimizing an area of the first volume behind the earpiece capsule when the second acoustic path is directed to the first acoustic volume while gaining optimum load at low frequencies.

10. The method of claim 6 further comprising arranging a size of the second acoustic path to provide an optimum acoustic load for the earpiece capsule at low frequencies.

11. An arrangement for improving the leak tolerance of a small earpiece in a housing of a mobile telephone, which comprises an earpiece capsule, a housing part between the earpiece capsule and the ear of a user for confining a first acoustic volume between said housing part and the user's ear, the user's ear being in substantially direct contact with the housing part, a first acoustic path disposed between the front part of the earpiece capsule and the first acoustic volume for directing sound from the front part of the earpiece capsule to said acoustic volume, and a second acoustic path disposed between the back part of the earpiece capsule and the first acoustic volume to compensate for the effect of changes in the first acoustic volume on the intensity and/or frequency characteristics of the sound sensed by the user's ear, the second acoustic path comprising an acoustic return path for low frequencies that operate as an acoustic load for the earpiece capsule at low frequencies the second acoustic path having the highest acoustic effect on low frequencies.

12. An arrangement according to claim 11, wherein said second acoustic path comprises holes arranged in said housing part.

13. An arrangement according to claim 11, wherein said second acoustic path comprises a structure attenuating high acoustic frequency components.

14. An arrangement according to claim 13, wherein said structure attenuating high acoustic frequency components is a second acoustic volume arranged for said second acoustic path.

15. The arrangement of claim 11 wherein the second acoustic path comprises a casing surrounding a rear and sides of the earpiece and forming a first volume behind the earpiece capsule that is smaller in area than a size of the earpiece capsule.

16. The arrangement of claim 15 further comprising attenuation material in the first volume behind the earpiece capsule to attenuate high frequency components of the sound.

17. The arrangement of claim 11 wherein a size of the apertures in the housing part between the earpiece capsule and the user earpiece are the same size as apertures in the housing part between the second acoustic path and first acoustic path.

18. A mobile station having a small earpiece which comprises:

an earpiece capsule, a housing part of the mobile station between the earpiece capsule and the ear of a user for confining the acoustic volume between said housing part and the user's ear, the user's ear being in substantially direct contact with the housing part, a first acoustic path arranged between the front part of the earpiece capsule and said acoustic volume for directing sound from the front part of the earpiece capsule to said acoustic volume, and a second acoustic path arranged from the back part of the earpiece capsule to said acoustic volume for improving leak tolerance by compensating the effect of changes in the first acoustic volume on the intensity and/or frequency characteristics of the sound sensed by the user's ear, the second acoustic path having the highest acoustic effect on low frequencies and comprising an acoustic return path for low frequencies that operate as an acoustic load for the earpiece capsule at low frequencies.

19. A mobile station according to claim 18, wherein said second acoustic path comprises a volume which has been arranged in the mobile station and which attenuates high acoustic frequency components.

20. A mobile station according to claim 18, wherein said housing part is the cover of the mobile station.

21. A mobile station according to claim 18, further comprising means for compensating the frequency response of the earpiece by means of digital signal processing.

22. A mobile station according to claim 18, further comprising means for compensating the frequency response of the earpiece by means of analog filtering.

23. The mobile station of claim 18 wherein the second acoustic path further comprises at least one aperture in the back part of the earpiece capsule.

24. The mobile station of claim 18 wherein the mobile station comprises a handheld mobile station for communicating in a mobile communication system.

25. The mobile station of claim 18 wherein the earpiece capsule occupies a volume that is larger than a volume in the second acoustic path behind the earpiece capsule.

* * * * *